US011596954B2

(12) United States Patent
Göhmann

(10) Patent No.: US 11,596,954 B2
(45) Date of Patent: Mar. 7, 2023

(54) SEPARATOR

(71) Applicant: GEA MECHANICAL EQUIPMENT GMBH, Oelde (DE)

(72) Inventor: Rüdiger Göhmann, Oelde (DE)

(73) Assignee: GEA MECHANICAL EQUIPMENT GMBH, Oelde (DE)

( * ) Notice: Subject to any disclaimer, the term of this patent is extended or adjusted under 35 U.S.C. 154(b) by 310 days.

(21) Appl. No.: 16/766,952

(22) PCT Filed: Nov. 15, 2018

(86) PCT No.: PCT/EP2018/081411
§ 371 (c)(1),
(2) Date: May 26, 2020

(87) PCT Pub. No.: WO2019/101624
PCT Pub. Date: May 31, 2019

(65) Prior Publication Data

US 2021/0031215 A1 Feb. 4, 2021

(30) Foreign Application Priority Data

Nov. 27, 2017 (DE) ..... 10 2017 128 027.8

(51) Int. Cl.
*B04B 7/08* (2006.01)
*B04B 1/08* (2006.01)
(Continued)

(52) U.S. Cl.
CPC ..... *B04B 1/08* (2013.01); *B04B 7/02* (2013.01); *B04B 7/08* (2013.01); *B04B 9/04* (2013.01); *B04B 9/12* (2013.01); *B04B 11/02* (2013.01)

(58) Field of Classification Search
CPC .... B04B 1/08; B04B 7/02; B04B 7/08; B04B 9/04; B04B 9/12; B04B 11/02
See application file for complete search history.

(56) References Cited

U.S. PATENT DOCUMENTS 9,115,725 B2 8/2015 Haefliger et al.
9,197,112 B2 * 11/2015 Stallinger ..... H02K 7/16
(Continued)

FOREIGN PATENT DOCUMENTS

CN 106040443 A * 10/2016 ..... B04B 1/00
CN 106824557 A * 6/2017
(Continued)

OTHER PUBLICATIONS

International Search Report dated Jan. 23, 2019 in related/corresponding International Application No. PCT/EP2018/081411.
(Continued)

*Primary Examiner* — Dung H Bui
(74) *Attorney, Agent, or Firm* — Patent Portfolio Builders PLLC

(57) ABSTRACT

A separator for separating a flowable suspension in a centrifugal field into at least two flowable phases of different density. The separator includes a housing, which is stationary during operation and is designed as a tank having at least three openings. The three openings include an inlet for an inflowing suspension and two outlets vertically spaced apart from each other for flowable phases of different density. Annular spaces of the housing are associated with the two outlets. A rotatable drum is arranged within the housing and has a vertical axis of rotation. The drum has three openings, corresponding to the openings of the housing. A multi-part support and drive device, which keeps the drum suspended within the housing, is supported and is set into rotation. An air gap is formed vertically between the two outlets and annular spaces of the housing during operation. The air gap is not filled with one of the outflowing phases during operation when the drum is rotating.

5 Claims, 1 Drawing Sheet

(51) Int. Cl.

| | |
|---|---|
| ***B04B 7/02*** | (2006.01) |
| ***B04B 9/04*** | (2006.01) |
| ***B04B 9/12*** | (2006.01) |
| ***B04B 11/02*** | (2006.01) |

(56) References Cited

U.S. PATENT DOCUMENTS

| | | | | |
|---|---|---|---|---|
| 10,022,729 | B2 | 7/2018 | Hartmann et al. | |
| 10,335,533 | B2 | 7/2019 | Heide | |
| 2006/0217254 | A1* | 9/2006 | Wase | C10M 175/0008 494/901 |
| 2010/0213777 | A1* | 8/2010 | de la Haye | B04B 9/04 310/90.5 |
| 2010/0216620 | A1* | 8/2010 | De La Haye | B04B 9/04 494/84 |
| 2015/0024922 | A1* | 1/2015 | Castillo Gonzalez | B04B 11/04 494/60 |
| 2016/0184836 | A1 | 6/2016 | Mackel et al. | |
| 2016/0279315 | A1* | 9/2016 | Heide | B04B 1/00 |

FOREIGN PATENT DOCUMENTS

| | | | | | |
|---|---|---|---|---|---|
| CN | 108283999 | A | * | 7/2018 | B03B 5/32 |
| CN | 106040443 | B | * | 10/2018 | B04B 1/00 |
| DE | 102009009958 | A1 | * | 9/2010 | B04B 9/04 |
| DE | 102009039729 | A1 | * | 3/2011 | B04B 11/08 |
| DE | 102013111586 | A1 | | 4/2015 | |
| EP | 2196265 | A2 | * | 6/2010 | B04B 1/20 |
| EP | 2273124 | B1 | | 2/2015 | |
| JP | H0618594 | Y2 | * | 5/1994 | B04B 9/12 |
| WO | WO-9740943 | A1 | * | 11/1997 | B04B 9/12 |
| WO | 2004053035 | A1 | | 6/2004 | |
| WO | WO-2005011871 | A1 | * | 2/2005 | B04B 1/2016 |
| WO | 2013116800 | A2 | | 8/2013 | |
| WO | 2014000829 | A1 | | 1/2014 | |
| WO | 2015110501 | A1 | | 7/2015 | |
| WO | WO-2016131446 | A1 | * | 8/2016 | B04B 9/04 |
| WO | WO-2016142161 | A1 | * | 9/2016 | |
| WO | WO-2016192927 | A1 | * | 12/2016 | B04B 1/08 |
| WO | WO-2017125072 | A1 | * | 7/2017 | B04B 13/00 |

OTHER PUBLICATIONS

Search Report created on Aug. 29, 2018 in related/corresponding DE Application No. 10 2017 128 027.8.

Written Opinion dated Jan. 23, 2019 in related/corresponding International Application No. PCT/EP2018/081411.

* cited by examiner

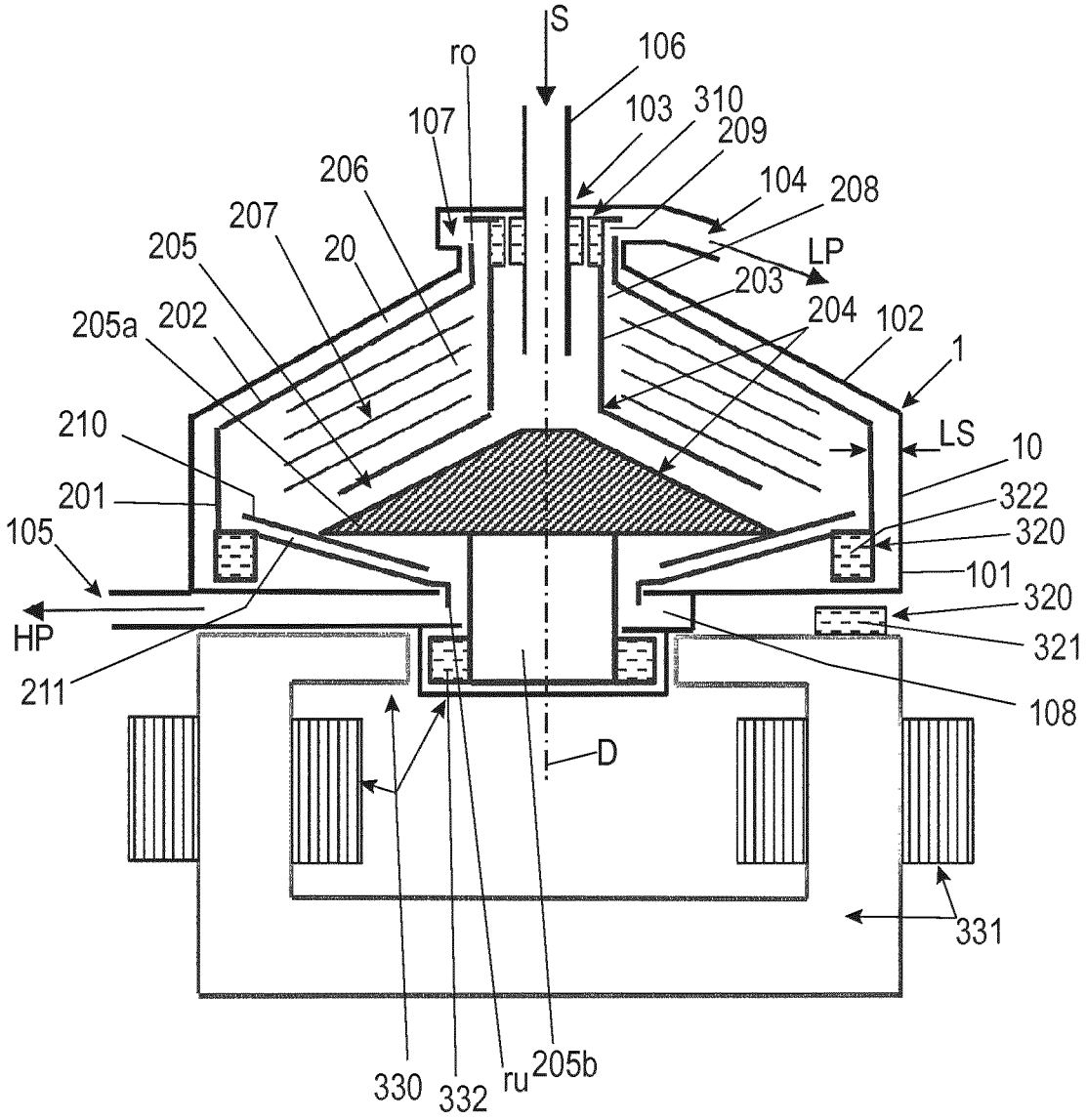
S
ro
106
107
103
310
209
206
104
208
207
205
20
LP
203
205a
202
204
102
1
210
LS
10
201
322
105
320
101
320
HP
321
211
108
D
331
330
332
ru
205b

SEPARATOR

BACKGROUND AND SUMMARY OF THE INVENTION

The invention relates to a separator for separating a flowable suspension in a centrifugal field into at least two flowable phases of different densities.

WO 2014/000829 A1 discloses a generic separator for separating a flowable product into different phases, which has a rotatable drum with a drum lower part and a drum upper part and a means for clarification arranged in the drum, wherein one, several or all of the following elements consist of plastic or a plastic composite material: the drum lower part, the drum upper part, the means for clarification. In this way it is possible to design a part of the drum or preferably even the entire drum—preferably together with the inlet and outlet systems or areas—for single use, which is of particular interest and advantage for the processing of pharmaceutical products such as fermentation broths or the like, since after operation for processing a corresponding product batch in preferably continuous operation during the processing of the product batch, no cleaning of the parts of the drum in contact with the product has to be carried out, but the entire drum can be replaced. This separator is therefore very advantageous from a hygienic point of view. In order to achieve a physical separation between this disposable drum and the drive, a non-contact coupling between drive and drum is advantageous.

WO2015/110501 A1 discloses a device for separating blood into two phases of different density comprising a magnetic drive device and a container that is set in rotational movement about its own axis by the drive device, wherein the container has at least one open end and at least one inlet therein, and wherein the container is magnetically suspended. Problematic in this respect is the unsatisfactorily resolved discharge of the two phases forming during centrifugal separation from the open, cup-like rotor.

WO 2015/110501 A1 discloses inserting the rotating container in a non-rotating housing surrounding the rotating container, which is closed except for an inlet and two outlets. Through the stationary housing, a central inlet pipe is fed vertically from above into the rotating container, from which a first phase is again pumped vertically upwards with a kind of peeling element and wherein the rotating container further has an overflow at its vertically upper end for a second phase, so that this flows into the surrounding non-rotating housing during operation, so that this fills up during operation until the liquid phase also flows out of the stationary housing again through an overflow. This design has the disadvantage that it is hardly possible to achieve higher speeds in a sensible way, as the inner—rotating—container rotates in the liquid collecting in the housing.

Exemplary embodiments involve a separator for separating a flowable suspension in a centrifugal field into at least two flowable phases of different densities, which comprises the following:

a) a housing which is stationary in operation and is designed as tank which has at least three openings, said openings comprising an inlet opening for an inflowing suspension and two vertically spaced outlets for flowable phases of different density, to which annular spaces of the housing are preferably assigned in each case, b) a rotatable drum arranged inside the housing with a vertical axis of rotation, which likewise has three openings corresponding to the openings of the housing from a), c) a multi-part support and drive device with which the drum is held in suspension, supported and rotated within the housing, d) wherein vertically between the two outlets and annular spaces of the housing an air gap is formed which is not filled with one of the outflowing phases but with a gas, in particular air, during operation when the drum is rotating.

In this way, one product phase can easily be fed in and two flowable product phases can be discharged without the drum in the housing being completely surrounded by the discharged product, which would slow it down. This makes it possible to reach and maintain higher speeds of up to 20000 rpm during operation without any problems.

According to an advantageous variant, it can be provided that the inlet is designed as an inlet pipe extending vertically from above towards the center of the housing and the two outlets are radially aligned.

It has then proved to be advantageous if the support and drive device has at least two permanent and/or electromagnetically acting bearing and/or drive units. In this way it is possible to influence the operating behavior of the drum in a more targeted manner than if this task is carried out with only one single support and drive unit.

Thus, it may be advantageous for one of the support and/or drive units to be designed as a first, axially acting magnetic bearing, which is formed below the drum and is essentially or exclusively designed to keep the drum suspended axially vertically.

It is further advantageous if a second of the support and/or drive units is designed to support the drum radially at its lower end and to set it in rotation.

Finally, the operating behavior can be further optimized in that a third of the support and/or drive units is designed and arranged as a radially acting magnetic bearing to support the drum at its upper axial end.

It can be further advantageous for achieving particularly high speeds and for particularly stable operation that the first liquid outlet is formed on the drum in the upper axial region—preferably at the upper axial end—and the second liquid outlet is formed in the lower axial region of the drum—preferably at the lower axial end of a cylindrical section of the drum.

It may further be advantageously provided that a device for adjusting the separation zone within the drum is assigned to at least one of the two liquid outlets.

And finally, it may also be advantageously provided that the housing has only the three openings and is otherwise hermetically sealed. This makes it easier to create a separator that has the disposable components of "drum" and "housing", whereas at least parts of the support and drive device are reusable.

BRIEF DESCRIPTION OF THE DRAWING FIGURE

In the following, the invention is described in more detail on the basis of embodiment examples with reference to the drawing, wherein further advantageous variants and embodiments are also discussed. It should be emphasized that the embodiment example discussed in the following is not intended to describe the invention conclusively, but that variants and equivalents not shown are also realizable and fall under the claims, wherein:

FIG. 1: shows a schematic representation of a centrifuge according to the invention.

DETAILED DESCRIPTION

The centrifuge 1 of FIG. 1 has a housing 10, which is stationary during operation. This housing consists of a plastic or a plastic composite material. The housing 10 here has a lower cylindrical section 101 and an upper conical section 102. The lower cylindrical section 101 can in turn be divided into cylindrical sections of different diameters.

The housing 10 is designed in the manner of a container, which is advantageously hermetically sealed except for three openings (yet to be discussed). These openings are an inlet opening 103 and two outlets 104, 105. The inlet opening 103 is penetrated by an inlet pipe 106 extending vertically from above towards the center of the housing 10. The two outlets 104, 105 extend here essentially radially.

The first outlet 104 is formed in the upper—here conical—section 102 of housing 10. It is preferably formed directly at the upper end of housing 10. The second outlet 105, on the other hand, is formed in the lower section 101, here cylindrical, and here in the vertically lower end of an area of the cylindrical section 101 of housing 10.

The outlets 104, 105 are preceded by annular spaces 107, 108 of the housing. These outlets allow liquid to drain from annular spaces 107, 108 during operation of the rotating drum 20. The significance and beneficial effects of these annular spaces 107, 108 are explained below.

The outlets 104, 105 of the housing are designed here as nozzles leading radially out of the housing 10, to which the lines, especially hoses or the like (not shown here), can be connected. Preferably, one inlet and several outlet lines, in particular outlet pipes or hoses, are connected to the inlet and outlet.

Inside the housing 10 is a rotating drum 20 with an imaginary "ideal" axis of rotation D, which is a vertical axis of rotation. The real axis of rotation deviates from this "ideal axis of rotation" D due to processional movements.

Drum 20 and its components are also made entirely or at least predominantly (ideally with the exception of magnets, which will be explained later) of a plastic or plastic composite material. Here, drum 20 also has a lower cylindrical section 201 and an upper conical section 202.

The inlet pipe 106 of housing 10, like this one, is stationary during operation. It extends vertically from above through the inlet openings of the housing 10 into the drum 20 up to a distributor pipe 203 of the distributor 204 of drum 20 concentric to the inlet pipe.

A bearing device 310 can be formed between the inlet pipe 106, which does not rotate during operation, and the rotating distributor pipe 203 of drum 20. This bearing device 310 is preferably designed as a radially acting magnetic bearing, which is intended to stabilize the drum 20 at its upper end during operation. This magnetic bearing at the upper end of drum 20—also known as the drum head—simply reduces possible pendulum movements of drum 2. For example, it has corresponding magnets distributed around the inlet pipe 106 and in the distributor pipe 203, which are radially spaced apart and interact in the manner of magnetic bearings.

The distributor pipe 203 of the distributor 204 opens downwards into radial distributor channels 205, which lead into a separation chamber or centrifugal chamber 206. In this separation chamber 206 a clarifying agent can be arranged like a plate pack 207. The distributor 204 may have a distributor base 205*a*, which in turn has a lower cylindrical projection 205*b*, which projects axially downwards from the drum 20, in particular from its cylindrical section 201.

In separation chamber 206, a suspension S to be processed, which is fed through the inlet pipe 106 into drum 20, is separated by centrifugal force into at least two flowable phases LP and HP of different densities in the driven rotary operation of drum 20. The phase LP of lower density flows radially inwards in separation chamber 206 and is there discharged upwards via a first discharge channel 208 into the radial discharge 209 and is ejected by this radially from the rotating drum into the first annular chamber 107. Here the phase LP leaves the drum at a radius ro. From there it flows—due to its impulse in the annular space in a circular motion—through the upper outlet 104 out of housing 10.

The phase HP of higher density flows radially outwards in the separation chamber 206 and is led downwards via a separating plate or an annular weir 210 into a second discharge channel 211 below the annular weir 210 here first radially inwards and from there is ejected radially from the rotating drum 20 into the second lower annular chamber 108. From there, this second liquid phase of greater density flows—due to its impulse in annular space 108 in a circular motion—through the second lower outlet 105 out of housing 10, where the phase HP leaves the drum at a radius ru. The ratio of ro to ru allows the radius of the separation zone between the two phases within the disc stack to be adjusted, thus enabling the flow rates of the individual phases to be regulated. For this purpose, the radius ru is changed in a simple way by means of an orifice plate (not shown here).

In the vertical area between the outlets 104 and 105, the housing 10 and the drum 20 are spaced from each other by an air gap LS. This is advantageous, since a high speed of drum 20 can be achieved relatively easily in this way. In this area, the air gap LS does not fill with one of the phases HP, LP to be discharged.

The drum 20 is held in suspension and rotated within the housing 10 by an electromagnetic support and drive device 30. The electromagnetic support and drive device 30 may have one or more bearing and/or drive units.

Here it preferably comprises at least two or three of these units.

For example, the electromagnetic support and drive device 30 may have the upper radially acting bearing device 310 already described.

The electromagnetic support and drive device 30 may also have a lower axially acting bearing device 320.

This axially acting bearing device 320 is essentially used to keep drum 20 in axial suspension by levitation within the housing 10. It may have first magnets 321 on an abutment, for example on the underside of the housing or on a stator 331 below housing 10.

In addition, the axially acting bearing device 320 may have second magnets 322 axially above the first magnets 321 and spaced apart therefrom in the lower area, in particular on the underside, of drum 20.

These first and/or second magnets 321, 322 can be designed as suitably aligned or polarized permanent magnets, in such a way that drum 1 can be held axially in suspension during rotation. These magnets 321, 322 can be arranged circumferentially or circumferentially distributed on two vertically aligned circles of the same diameter in such a way that their effect ensures that drum 20 is held in axial magnetic levitation within the housing. Electromagnets, including a suitable control device (not shown here), can also be used for the function of the first magnets 321.

The electromagnetic support and drive device 30 may also include an electric motor 330, the rotor magnet 332 of which is formed on the drum 20 and the stator 331 and stator magnet 333 of which is formed outside the housing 10. The centering of the drum is achieved by suitable control of the stator magnets 333.

The drive device can be operated electromagnetically. However, a drive via rotating permanent magnets is also possible.

Such support and drive devices are used by the Levitronix company, for example, for driving centrifugal pumps (EP2273124B1).

During operation, drum 20 rotates, keeping it axially in suspension and centering it radially. Drum 20 is preferably operated at a speed of between 1,000 and 20,000 rpm. The forces generated by the rotation lead to the separation of a suspension to be processed into different flowable phases and to their discharge, as described in detail above.

With the embodiment described, it is again possible to create a separator together with housing that can be designed for single use except for the drive system and parts of the bearing, which in turn is particularly interesting and advantageous for the processing of pharmaceutical products such as fermentation broths or the like, since after operation for processing a corresponding product batch in preferably continuous operation during the processing of the product batch, no cleaning of the drum has to be carried out but the separator together with housing can be replaced as a whole. If necessary, individual elements such as magnets can be suitably recycled.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

List of Reference Numerals

Centrifuge 1
Housing 10
Lower cylindrical section 101
Upper conical section 102
Inlet opening 103
Outlets 104, 105
Inlet pipe 106
Annular spaces 107, 108
Drum 20
Lower cylindrical section 201
Upper conical section 202
Distributor pipe 203
Distributor 204
Distributor channels 205
Separation chamber 206
Plate pack 207
Distributor base 205*a*
Cylindrical projection 205*b*
Discharge channel 208
Discharge 209
Annular weir 210
Discharge channel 211
Support and drive device 30
Upper radial bearing device 310
Lower axial bearing device 320
First magnets 321
Stator 331
Second magnets 322
Electric motor 330
Stator 331
Rotor magnet 332
Stator magnet 333
Axis of rotation D
Suspension S
Flowable phases LP and HP
Air gap LS
Upper radius ro
Lower radius ru

The invention claimed is:

1. A separator for separating a flowable suspension in a centrifugal field into at least two flowable phases of different densities, the separator comprising:

a housing, which is stationary during operation of the separator, wherein the housing is a tank having at least three openings, wherein the at least three openings include an inlet for an inflowing suspension and first and second vertically spaced outlets for flowable phases of different density, wherein a first annular space is fluidically coupled to the first vertically spaced outlet and a second annular space is fluidically coupled to the second vertically spaced outlet;

a rotatable drum arranged inside the housing, wherein the rotatable drum has a vertical axis of rotation, and wherein the rotatable drum has three openings corresponding to the at least three openings of the housing;

an air gap arranged in a vertical space between the first outlet and annular space and the second outlet and annular space, wherein during operation of the separator the air gap is not filled with any outflowing phases of the flowable suspension;

an axially acting magnetic bearing configured to maintain the rotatable drum in suspension, wherein the axially acting magnetic bearing is arranged on an underside of the rotatable drum;

an electric motor arranged below the drum and a rotor magnet affixed on the drum, wherein the electric motor is configured to radially center and rotate the rotatable drum at a lower end of the rotatable drum; and a radially acting magnetic bearing arranged at an upper axial end of the rotatable drum and configured to reduce pendulum movement of the rotatable drum at the upper axial end of the rotatable drum, wherein the housing has only the three openings and is otherwise hermetically sealed, and wherein the rotatable drum is made at least predominantly of a plastic or plastic composite material.

2. The separator of claim 1, wherein the inlet is an inlet pipe extending vertically from above the separator in a direction of a center of the housing, and the first and second outlets are radially aligned.

3. The separator of claim 1, further comprising:

a distributor and a plate pack arranged in the rotatable drum.

4. The separator of claim 1, wherein the three openings of the rotatable drum include a first liquid outlet, which is formed on an upper axial region of the rotatable drum and a second liquid outlet, which is formed in a lower axial region of the rotatable drum.

5. The separator of claim 1, wherein at least one of the first and second liquid outlets is associated with a device for adjusting a separation zone within the rotatable drum.

* * * * *